US006945301B1

(12) United States Patent
Nien

(10) Patent No.: US 6,945,301 B1
(45) Date of Patent: Sep. 20, 2005

(54) TELESCOPIC TUBE OF UPPER BEAM OF VERTICAL TYPE VENETIAN BLIND

(76) Inventor: Leslie Nien, No. 45-4, Fan Po St., Fu Hsing Hsiang, Changhua Hsien (TW)

( * ) Notice: Subject to any disclaimer, the term of this patent is extended or adjusted under 35 U.S.C. 154(b) by 0 days.

(21) Appl. No.: 10/778,398

(22) Filed: Feb. 17, 2004

(51) Int. Cl.[7] ..... E06B 9/30
(52) U.S. Cl. ..... 160/168.1 V
(58) Field of Search ..... 160/168.1 V, 173 V, 160/178.1 V, 900, 168.1 R, 172 V, 176.1 V, 160/177 V

(56) References Cited

U.S. PATENT DOCUMENTS 4,425,955 A * 1/1984 Kaucic ..... 160/168.1 V
4,449,564 A * 5/1984 Hansen et al. ..... 160/168.1 V
4,724,883 A * 2/1988 Liebowitz ..... 160/84.01
4,791,703 A * 12/1988 Chang ..... 16/94 D
4,799,527 A * 1/1989 Villoch et al. ..... 160/168.1 V

* cited by examiner

*Primary Examiner*—David Purol
(74) *Attorney, Agent, or Firm*—Troxell Law Office, PLLC

(57) ABSTRACT

A telescopic tube of an upper beam of a vertical type Venetian blind includes a major/minor telescopic upper beam, two rows of sliding clamp blocks, two linkage actuated members, and two guide straps wherein the major/minor telescopic upper beam has opposite grooved guide tracks symmetrically extending inwards at the open bottom side thereon for the guide straps to be adapted therein, and the sliding clamp blocks are serially linked via X-shaped linking bars each pivotally joined to the others in linkage connection. The linkage actuated member, inverted U-shaped, is precisely bridged at the opposite grooved guide tracks thereon. When the two rows of the sliding clamp blocks are activated by the X-shaped linking bars, clamping parts of the sliding clamp blocks disposed at the front section of each row thereof are sequentially displayed at a movement slot of the linkage actuated member therein till a clamping part located at a retaining hole of an adjustment block therein is pulled to activate the linkage actuated member moving smoothly forwards therewith along the guide straps at the grooved guide tracks therein. Thus, pulling force is synchronically formed at both the front and middle sections of each row of the sliding clamp blocks, evenly unfolding the sliding clamp blocks of both the front and rear sections thereof at the same time and equidistantly display blades attached at the clamping parts thereof to achieve the overall beauty as well as the best sheltering effect of the vertical type Venetian blind thereof.

2 Claims, 4 Drawing Sheets

TELESCOPIC TUBE OF UPPER BEAM OF VERTICAL TYPE VENETIAN BLIND

BACKGROUND OF THE INVENTION

The present invention is related to a telescopic tube of an upper beam of a vertical type Venetian blind, comprising a major/minor telescopic upper beam, two rows of sliding clamp blocks, two linkage actuated members, and two guide straps wherein the major/minor telescopic upper beam has opposite grooved guide tracks disposed at the open bottom side thereon for the guide straps to be adapted therein, and the sliding clamp blocks are serially connected into rows via X-shaped linking bars; whereby, when the two rows of the sliding clamp blocks are activated by the X-shaped linking bars thereof, clamping parts of the sliding clamp blocks disposed at the front section of each row thereof are sequentially displayed at a movement slot of the linkage actuated member therein till a clamping part located at a retaining hole of an adjustment block therein is pulled to activate the linkage actuated member which is then moved smoothly forwards therewith along the guide straps at the grooved guide tracks therein, forming pulling force synchronically at both the front and middle sections thereof to equidistantly display the sliding clamp blocks with blades attached at the clamping parts thereof so as to achieve the overall beauty as well as the best sheltering effect of the vertical type Venetian blind thereof.

Please refer to FIG. 1. A conventional telescopic tube of an upper beam of a vertical type Venetian blind is made up of an inverted U-shaped major/minor telescopic upper beam 10, sliding clamp blocks 12 serially connected into two rows via a plurality of X-shaped linking bars 11 to be adapted at both inner side of the telescopic upper beam 10 thereof respectively. Each sliding clamp block 12 has a protruded part 122 disposed at the top thereof, two cord passages 121 disposed at the protruded part 122 thereon for pull cords 13 to be led there-through respectively, and a clamping part 124 extending downwards at the bottom thereof. Two major/minor telescopic adjusting rods 14 are respectively led through symmetrical adjusting holes 123 disposed at both lateral sides of the sliding clamp block 12 thereon. And a rotary gearing rod works with a helical gearing to adjust the angle of blades 15 attached to the clamping parts 124 of the sliding clamp blocks 12 thereof. Via the pull cords 13 matching to the X-shaped linking bars 11 thereof, the two rows of sliding clamp blocks 12 in linkage connection are activated to move at the major/minor telescopic upper beam 10 therein via rollers 125 sliding along the grooved guide tracks 101 symmetrically disposed at the open bottom side of the major/minor telescopic upper beam 10 thereof as shown in FIG. 2. Besides, the major/minor telescopic upper beam 10 can be properly adjusted to fit into windows of different width.

There are some drawbacks to such conventional telescopic tube of an upper beam of a vertical type Venetian blind. First, to display the vertical type Venetian blind thereof as shown in FIG. 1, the X-shaped linking bars 11 are drawn from the corresponding inner side thereof, activating the sliding clamp blocks 12 to unfold in a sequence therewith. The X-shaped linking bars 11 disposed at the front section thereof must be fully extended before the linking bars 11 disposed at the rear section are actuated to move forwards therewith, which may result in the incomplete display of the linking bars 11 at the rear section thereof.

Thus, the blades 15 attached at the clamping parts 124 of the sliding clamp blocks 12 can't be equidistantly unfolded in display, which not only mars the overall beauty of the vertical type Venetian blind, but also fails to provide the best sheltering effect thereof. Second, due to the design of the major/minor telescopic upper beam 10 thereof, a step-wise flange 102 is produced at the joint of the grooved guide tracks 101 of the major/minor telescopic upper beam 10 thereof, which may unevenly hinder or stop the rollers 125 thereof in movement as shown in FIG. 2. Thus, pulling force must be instantly applied to release the rollers 125 from the step-wise flange 102 thereof for them to continue the movement thereof, which is quite inconvenient in practical use.

SUMMARY OF THE PRESENT INVENTION

It is, therefore, the primary purpose of the present invention to provide a telescopic tube of an upper beam of a vertical type Venetian blind, comprising a major/minor telescopic upper beam, two rows of sliding clamp blocks, two linkage actuated members, and two guide straps; whereby, when the two rows of the sliding clamp blocks are activated by X-shaped linking bars in display, clamping parts of the sliding clamp blocks disposed at the front section of each row thereof are sequentially unfolded at a movement slot of the linkage actuated member therein till a clamping part located at a retaining hole of an adjustment block therein is pulled to activate the linkage actuated member moving smoothly forwards therewith along the guide straps at the grooved guide tracks therein, forming pulling force synchronically at both the front and middle sections of each row thereof to evenly unfold the sliding clamp blocks of both the front and the rear sections thereof at the same time and equidistantly display blades attached at the clamping parts thereof, facilitating the overall beauty as well as the best sheltering effect of the vertical type Venetian blind thereof.

It is, therefore, the secondary purpose of the present invention to provide a telescopic tube of an upper beam f a vertical type Venetian blind wherein the major/minor telescopic upper beam has opposite grooved guide tracks disposed at the open bottom side thereon for the guide straps to be adapted therein so that rollers disposed at both lateral sides of each sliding clamp block thereof are smoothly moved along the guide straps at the grooved guide tracks therein, effectively avoiding the stop or hindrance of the rollers due to the step-wise flange disposed at the joint of the major/minor telescopic upper beam thereof to achieve the best using condition thereof.

DETAILED DESCRIPTION OF THE PREFERRED EMBODIMENTS

Figure 3:
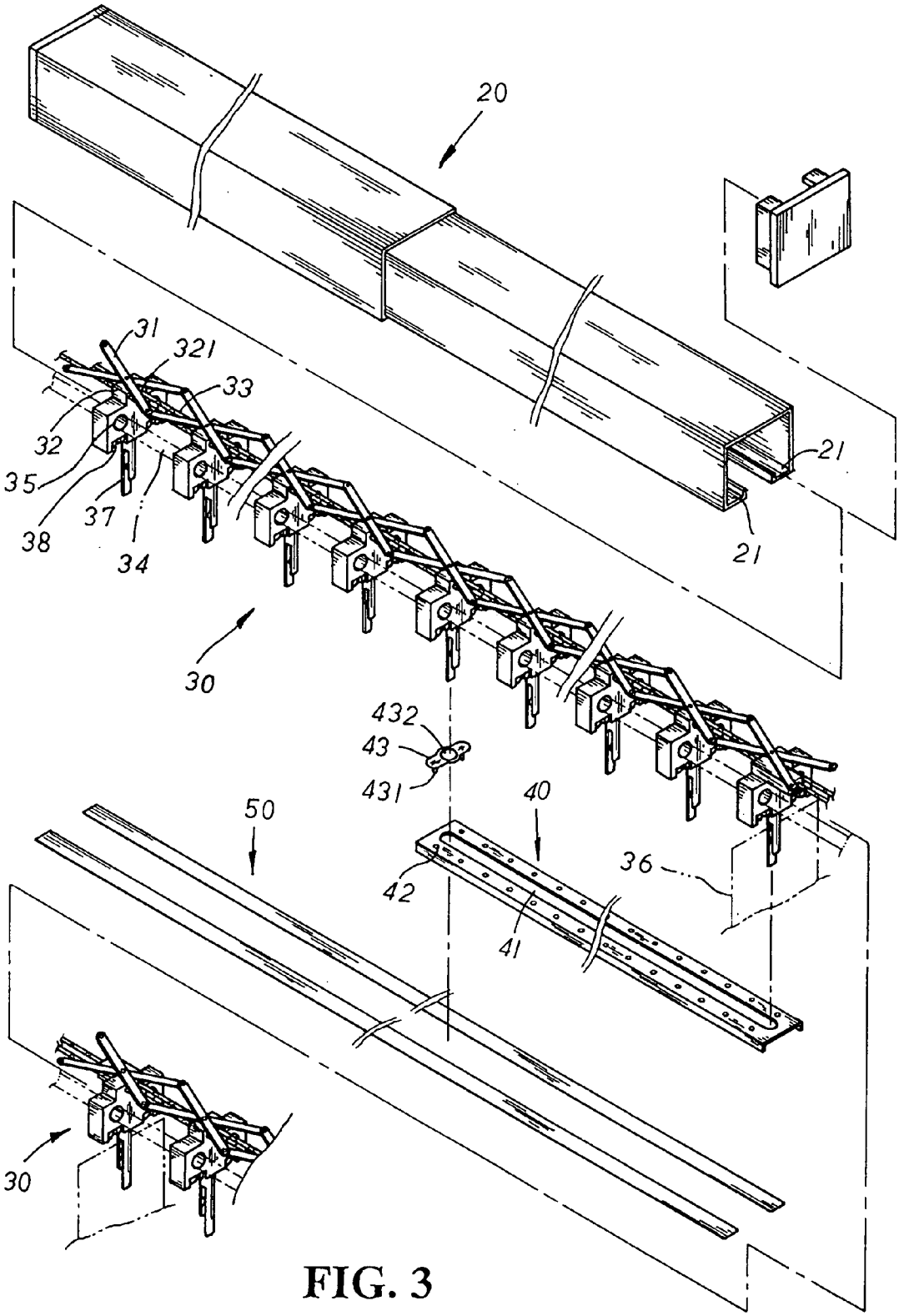
FIG. 3 is a perspective exploded view of the present invention.

Please refer to FIG. 3. The present invention is related to a telescopic tube of an upper beam of a vertical type Venetian blind, comprising a major/minor telescopic upper beam 20, two rows of sliding clamp blocks 30, two linkage actuated members 40, and two guide straps 50. The major/minor telescopic upper beam 20 is inverted U-shaped, having a pair of opposite grooved guide tracks 21 symmetrically extending inwards at both lateral edges of the open bottom side thereon. The sliding clamp blocks 30 are serially strung into rows via a plurality of X-shaped linking bars 31 each pivotally joined to the others in linkage connection. Each of the sliding clamp blocks 30 thereof is provided with a protruded part 32 extending at the top thereof, two cords passages 321 symmetrically disposed at the protruded part 32 thereon for two pull cords 33 to be passed there-through respectively, and two opposite adjusting holes 35 symmetrically disposed at both lateral sides of the sliding clamp block 30 thereon for two major/minor telescopic adjusting rods 34 to be led there-through respectively. The sliding clamp block 30 thereof also includes a clamping part 37 extending downwards at the bottom side thereof for holding a blade 36 of the vertical type Venetian blind thereby. Via a rotary gearing rod in working with a helical gearing, the clamping part 37 of the sliding clamp block 30 thereof is rotated to adjust the angle of the blade 36 thereof. Both lateral sides of the clamping part 37 thereof are disposed a roller 38 respectively via which each sliding clamp block 30 with the blade 36 attached thereto is smoothly moved thereby when guided by the pull cords 33 in working with the X-shaped linking bars 31 thereof to actuate the two rows of sliding clamp block 30 thereof. The linkage actuated member 40 is inverted U-shaped, having two lateral sides to be precisely bridged at the opposite grooved guide tracks 21 of the major/minor telescopic upper beam 20 thereof and located thereon without any deviation there-from. The upper surface of the linkage actuated member 40 is defined by a movement slot 41 with a plurality of coupling holes 42 symmetrically disposed at both lateral sides of the movement slot 41 thereon for coupling poles 431 of an adjustment block 43 to be engaged therewith. The adjustment block 43 thereof has a retaining hole 432 disposed at the center thereon, and the guide straps 50 thereof are matched to the opposite grooved guide tracks 21 thereof respectively.

Figure 1:
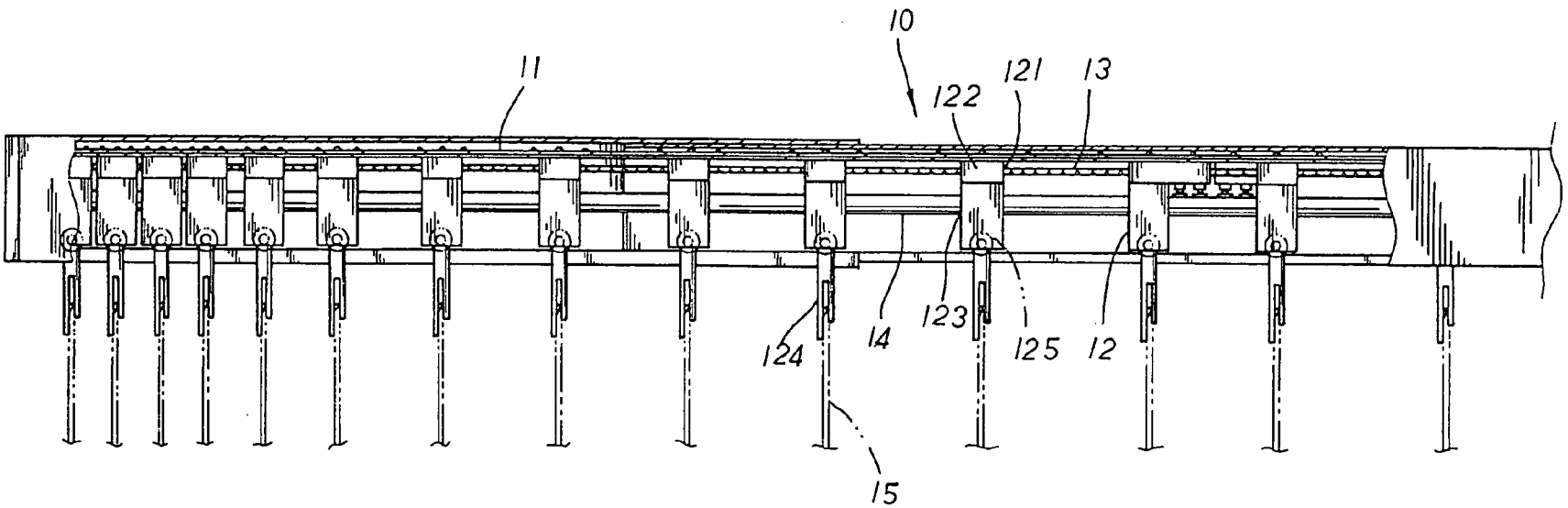
FIG. 1 PRIOR ART
FIG. 1 is a diagram showing a conventional telescopic upper beam of a vertical type Venetian blind incompletely displayed in practical use.
Figure 2:
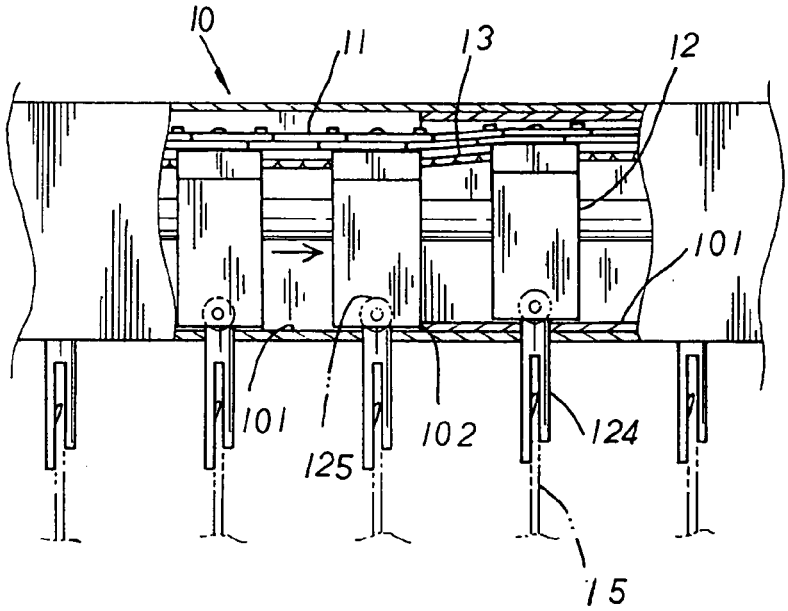
FIG. 2 PRIOR ART
FIG. 2 is a cross section view of rollers of a conventional telescopic upper beam thereof stopped or hindered in movement by the upper beam thereof.
Figure 4:
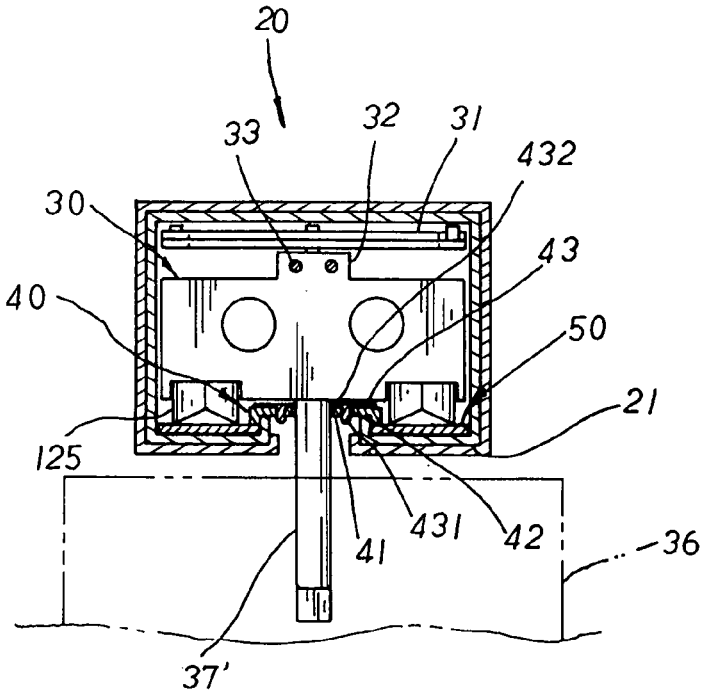
FIG. 4 is a cross sectional view of the present invention in assembly.

Please refer to FIG. 4. In assembly, the two guide straps 50 are adapted into the opposite grooved guide tracks 21 of the major/minor telescopic upper beam 20 respectively, and the two linkage actuated members 40 are respectively applied onto the two rows of sliding clamp blocks 30 in linkage connection via the X-shaped linking bars 31 thereof. The movement slot 41 of each linkage actuated member 40 is led through the sliding clamp blocks 30 disposed at the front section of the connected X-shaped linking bars 31 thereof with the clamping parts 37 thereof extending downwards at the bottom therein. A clamping part 37' of the sliding block 30 limited at one inner side of the movement slot 41 thereof is led through the retaining hole 432 of the adjustment block 43 and located thereby via the coupling poles 431 thereof engaged with the coupling holes 42 of the linkage actuated member 40 thereof. The two rows of sliding clamp blocks 30 are adapted into both inner sides of the major/minor telescopic upper beam 20 therein with each linkage actuated member 40 precisely bridging at the opposite grooved guide tracks 21 thereof and movably slid with the sliding clamp blocks 30 limited at the movement slot 41 therein. Meanwhile, the rollers 38 are smoothly moved along the guide straps 50 adapted at the grooved guide tracks 21 of the major/minor telescopic upper beam 20 therein to complete the assembly of the present invention.

Figure 5:
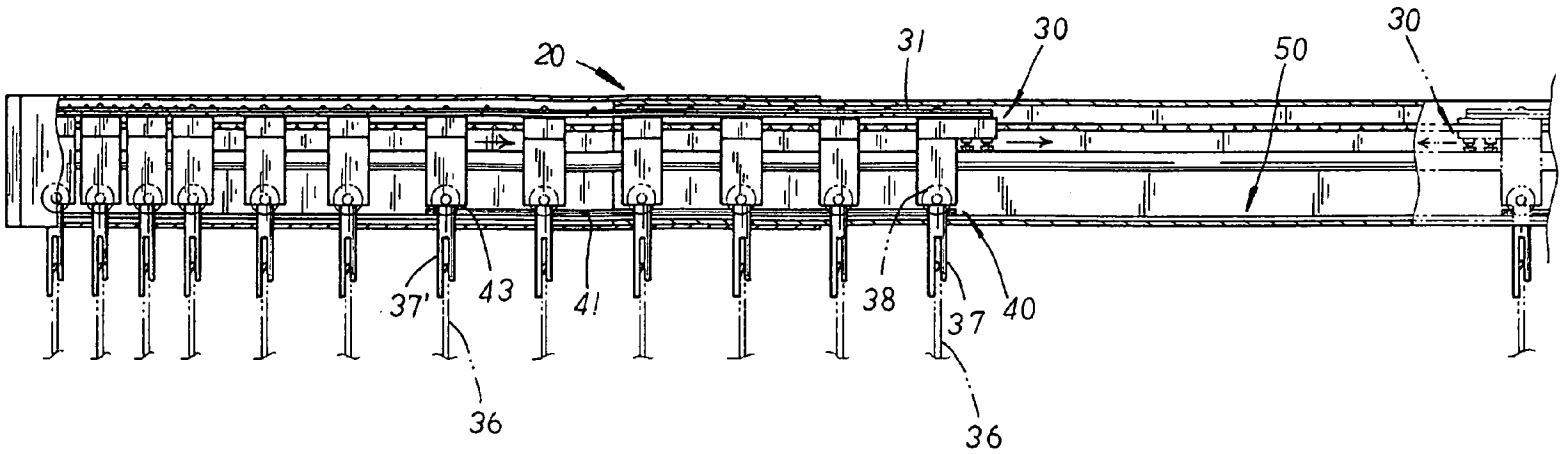
FIG. 5 is a diagram showing the present invention in unfolding operation thereof.
Figure 6:
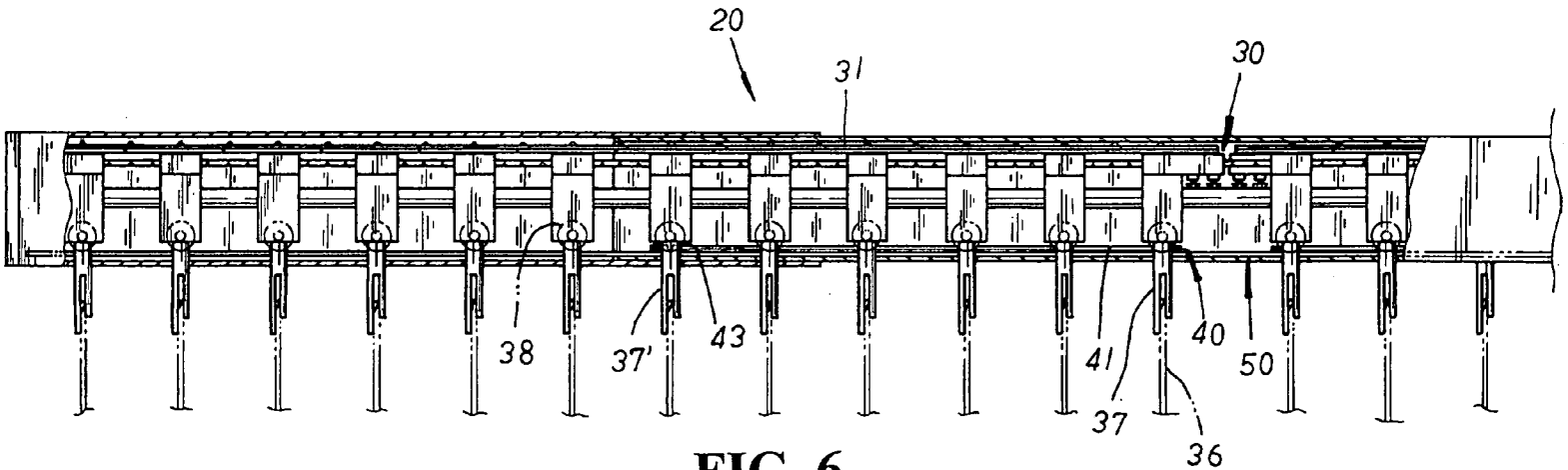
FIG. 6 is a diagram showing the present invention fully displayed in practical use.

Please refer to FIGS. 5 to 6 inclusive. Via the guide straps 50 thereof, the rollers 38 of the sliding clamp blocks 30 are smoothly moved at the grooved guide tracks 21 therein to evenly display the vertical type Venetian blind thereof without any stop or hindrance in movement by the step-wise flange disposed at the joint of the grooved guide tracks 21 of the major/minor telescopic upper beam 20 thereof. Besides, via the linkage actuated members 40, the two rows of sliding clamp blocks 30 correspondingly slid forwards by the X-shaped linking bars 31 thereof are gradually and precisely displayed in equal distance. The clamping parts 37 of the sliding clamp blocks 30 limited at the movement slot 41 of the linkage actuated member 40 therein are sequentially unfolded till the clamping part 37' located at the retaining hole 432 of the adjustment block 43 therein is drawn forwards therewith, activating the linkage actuated member 40 to move along the guide straps 21 at the grooved guide tracks 21 therein. Thus, pulling force is synchronically formed at both the front end of each row of the sliding clamp blocks 30 thereof and the clamping part 37' disposed at the middle section thereof. The sliding clamp blocks 30 disposed at both the front and rear sections thereof are then evenly unfolded at the same time with the blades 36 attached at the clamping parts 37 of the sliding clamping blocks 30 thereof equidistantly arranged in neat display as shown in FIG. 6, achieving the overall beauty as well as the best sheltering effect of the vertical type Venetian blind thereof.

What is claimed is:

1. A telescopic tube assembly for a vertical Venetian blind comprising:

a) a telescopic beam having two grooved guide tracks and an opening located between the two grooved guide tracks;

b) two guide straps, each of the two guide straps is located in one of the two grooved guide tracks;

c) two rows of sliding clamp blocks, each of the two rows of sliding clamp blocks having:

i) a plurality of sliding clamp blocks, each of the plurality of sliding clamp blocks having two adjusting holes, a protruded part located on a top thereof and having two cord passages, and a clamping part located on a bottom thereof;

ii) a plurality of linking bars, each of the plurality of linking bars being located between two adjacent sliding clamp blocks of the plurality of sliding clamp blocks;

iii) two telescopic adjusting rods, one of the two telescopic adjusting rods slidably inserted through each of the two adjusting holes of each of the plurality of sliding clamp blocks;

iv) a rotary gearing rod and a helical gear being connected to the clamping part and controlling a rotation of a blade of the vertical Venetian blind connected to each clamping part;

d) two pull cords controlling a movement of the plurality of sliding clamp blocks and the plurality of linking bars, one pull cord inserted through each of the two cord passages of each of the plurality of sliding clamp blocks; and e) two linkage actuated members slidable located in the two grooved guide tracks, each of the two linkage actuated members having:

i) a movement slot, each clamping part of a predetermined number of the plurality of sliding clamp blocks is slidably inserted into the movement slot;

ii) a plurality of pairs of holes located on opposing sides of the movement slot; and iii) an adjustment block having two coupling poles and a retaining hole located between the two coupling poles, a selected clamping part being inserted into each retaining hole, the two poles being inserted into a selected pair of the plurality of pairs of holes.

2. The telescopic tube assembly according to claim 1, wherein each of the two linkage actuated members has two lateral sides, one of the two lateral sides is inserted into each of the two grooved guide tracks.

* * * * *